US011052002B2

(12) United States Patent
Garland et al.

(10) Patent No.: US 11,052,002 B2
(45) Date of Patent: Jul. 6, 2021

(54) VEHICLE WHEEL ASSEMBLY

(71) Applicant: Airbus Defence and Space Limited, Stevenage (GB)

(72) Inventors: Martin Garland, Hertfordshire (GB); Daisy Lachat, Hertfordshire (GB); Annette Remion, Hertfordshire (GB); David Lines, Hertfordshire (GB)

(73) Assignee: AIRBUS DEFENSE AND SPACE LIMITED, Hertfordshire (GB)

( * ) Notice: Subject to any disclaimer, the term of this patent is extended or adjusted under 35 U.S.C. 154(b) by 0 days.

(21) Appl. No.: 16/342,408

(22) PCT Filed: Oct. 19, 2017

(86) PCT No.: PCT/EP2017/076772
§ 371 (c)(1),
(2) Date: Apr. 16, 2019

(87) PCT Pub. No.: WO2018/073377
PCT Pub. Date: Apr. 26, 2018

(65) Prior Publication Data

US 2019/0290514 A1 Sep. 26, 2019

(30) Foreign Application Priority Data

Oct. 21, 2016 (EP) ..... 16275157

(51) Int. Cl.
*A61G 5/06* (2006.01)
*A61G 5/04* (2013.01)

(52) U.S. Cl.
CPC ..... *A61G 5/061* (2013.01); *A61G 5/045* (2013.01)

(58) Field of Classification Search
CPC ..... A61G 5/045; A61G 5/06; A61G 5/061; A61G 5/065; A61G 5/068; B62B 5/02;
(Continued)

(56) References Cited

U.S. PATENT DOCUMENTS 4,132,423 A 1/1979 Chant
4,222,449 A 9/1980 Feliz
(Continued)

FOREIGN PATENT DOCUMENTS

JP 62-26174 A 2/1987
JP H023577 U 1/1990
WO 2016131095 A1 8/2016

OTHER PUBLICATIONS

Office Action (Notice of Allowability) dated Feb. 21, 2020, by the U.S. Patent and Trademark Office in corresponding U.S. Appl. No. 16/342,405. (9 pages).
(Continued)

*Primary Examiner* — Minnah L Seoh
*Assistant Examiner* — Maurice L Williams
(74) *Attorney, Agent, or Firm* — Buchanan Ingersoll & Rooney PC

(57) ABSTRACT

A disclosed vehicle wheel assembly includes a plurality of wheels, a plurality of rotary drive modules each having a respective rotation axis, and a plurality of rotatable arms, wherein each arm is arranged to extend radially from a rotation axis of a respective rotary drive module to couple the respective rotary drive module to a respective wheel. Each rotary drive module is operable to drive rotation of a respective rotatable arm about the rotation axis of the drive module, to thereby rotate a respective wheel about the rotation axis. A control module can sense stepped terrain, and control each rotary drive module to enable a vehicle to travel over the stepped terrain.

14 Claims, 8 Drawing Sheets

(58) Field of Classification Search
CPC ..... B62B 5/026; B62B 9/02; Y10S 280/10; B62D 57/02; B62D 57/024; B62D 57/032; B62D 61/12
See application file for complete search history.

(56) References Cited

U.S. PATENT DOCUMENTS

| | | | | |
|---|---|---|---|---|
| 4,566,551 | A | 1/1986 | Feliz | |
| 4,676,765 | A | 6/1987 | Mckay et al. | |
| 5,230,522 | A | 7/1993 | Gehlsen et al. | |
| 5,447,317 | A | 9/1995 | Gehlsen et al. | |
| 5,507,358 | A | 4/1996 | Abe et al. | |
| 5,579,857 | A | 12/1996 | Abe et al. | |
| 6,062,600 | A * | 5/2000 | Kamen | A61G 5/04 280/755 |
| 6,553,271 | B1 * | 4/2003 | Morrell | B60L 50/60 700/75 |
| 6,575,491 | B2 * | 6/2003 | Miller | B62B 3/027 280/43.17 |
| 7,246,671 | B2 * | 7/2007 | Goren | A61G 5/061 180/209 |
| 7,384,046 | B2 * | 6/2008 | Le Masne De Chermont | A61G 5/045 180/65.51 |
| 7,398,843 | B2 * | 7/2008 | Buehler | B25J 5/007 180/24.02 |
| 7,422,079 | B2 * | 9/2008 | Hsiao | A61G 5/061 180/65.1 |
| 7,426,970 | B2 * | 9/2008 | Olsen | A61G 5/046 180/65.1 |
| 7,503,567 | B2 * | 3/2009 | Frankie | A61G 5/04 180/8.2 |
| 7,677,345 | B2 * | 3/2010 | Hosoda | B62D 57/024 180/218 |
| 7,784,569 | B2 * | 8/2010 | Cheng | A61G 5/046 180/8.2 |
| 7,850,189 | B2 | 12/2010 | Barber et al. | |
| 2002/0121394 | A1 | 9/2002 | Kamen et al. | |
| 2004/0163869 | A1 * | 8/2004 | Chun | B60K 7/0023 180/209 |
| 2005/0023052 | A1 | 2/2005 | Beck et al. | |
| 2006/0145433 | A1 * | 7/2006 | Kim | A61G 5/061 280/5.28 |
| 2007/0080001 | A1 | 4/2007 | Beck et al. | |
| 2009/0108561 | A1 | 4/2009 | Barber et al. | |
| 2009/0174168 | A1 * | 7/2009 | Pavlopoulos | A61G 5/061 280/250.1 |
| 2010/0076598 | A1 * | 3/2010 | Herbert | B62D 57/02 700/245 |
| 2012/0285761 | A1 * | 11/2012 | Lee | B62D 57/024 180/209 |
| 2014/0083788 | A1 | 3/2014 | Behrens | |
| 2014/0232085 | A1 * | 8/2014 | Hsiao-Wecksler | A61G 5/02 280/250.1 |
| 2015/0129328 | A1 | 5/2015 | Behrens | |
| 2015/0272793 | A1 * | 10/2015 | Lu | A61G 5/061 280/5.26 |
| 2016/0067122 | A1 * | 3/2016 | Aviv | A61G 5/068 280/5.3 |
| 2018/0028380 | A1 | 2/2018 | Behrens | |

OTHER PUBLICATIONS

International Search Report (PCT/ISA/210) dated Jan. 8, 2018, by the European Patent Office as the International Searching Authority for International Application No. PCT/EP2017/076772.

International Search Report (PCT/ISA/210) dated Jan. 4, 2018, by the European Patent Office as the International Searching Authority for International Application No. PCT/EP2017/076769.

Notification of Transmittal of The International Preliminary Report on Patentability (PCT Article 36 and Rule 70) (Form PCT/IPEA/409) dated Feb. 6, 2019, by the European Patent Office for International Application No. PCT/EP2017/076772.

Notification of Transmittal of the International Preliminary Report on Patentability (PCT/IPEA/409) dated Jan. 14, 2019, by the European Patent Office as the International Preliminary Examining Authority for International Application No. PCT/EP2017/076769.

Written Opinion (PCT/ISA/237) dated Jan. 8, 2017, by the European Patent Office as the International Searching Authority for International Application No. PCT/EP2017/076772.

Written Opinion (PCT/ISA/237) dated Jan. 4, 2018, by the European Patent Office as the International Searching Authority for International Application No. PCT/EP2017/076769.

* cited by examiner

VEHICLE WHEEL ASSEMBLY

TECHNICAL FIELD

The present invention relates to a wheel assembly for a vehicle, and particularly, but not exclusively, to a wheel assembly for enabling a wheeled vehicle to traverse stepped terrain, such as a staircase.

BACKGROUND ART

Enabling vehicles to navigate difficult terrain more effectively is a topic which has been researched both for terrestrial applications and applications in space. Many conventional solutions are complex, big, heavy, cumbersome, and expensive, and require substantial modification of the vehicle itself. This makes solutions inaccessible, or impractical for many users or applications.

For example, many wheelchair users frequently encounter small obstacles such as steps or curbs and would conventionally use a manually-arranged device such a ramp to enable such obstacles to be traversed, although this can be an inconvenient solution where mobility of the wheelchair user is restricted. An example of a more complex solution to enable wheelchair users to traverse such obstacles without such manual intervention is that the Topchair-S developed by Topchair, a wheelchair which can traverse flights of stairs. The system is large and heavy and cannot be installed on an existing wheelchair, and is thus a design intended to replace a user's wheelchair. The system uses a track-based undercarriage analogous to those used in military or construction vehicles to bridge across step edges. Since the design replaces a conventional wheelchair, and is optimised for climbing flights of stairs, its design is not optimised for travel on smooth terrain, and may therefore be undesirable for general daily use.

Another example of a known wheelchair design is the iBOT wheelchair designed by DEKA. As with the Topchair-S, the design is a replacement of a user's conventional wheelchair and its principle of operation is based on two dipole wheel systems in which pairs of wheels in each dipole can be rotated around each other to facilitate traversal of particular terrain. The design is complex, requiring multiple wheels in each wheel assembly, and in use, often requires the wheelchair to balance on only a single wheel of each of the pairs, an inherently unstable arrangement. In addition, the wheelchair is expensive.

An example of a vehicle designed for navigating difficult terrain in space is the All-Terrain Hex-Limbed Extra-Terrestrial Explorer (ATHLETE) developed by NASA as a prototype for possible future space missions. ATHLETE is a configuration which is able to "walk" on terrain, through raising and lowering limbs. The limbs have wheels as "feet" to further facilitate traversal of terrain. The design therefore represents a standalone vehicle for a specific application, and since the walking action is achieved through the reciprocating motion of raising and lowering of each limb, progress of the vehicle is slowed as each limb motion must be separately calculated and processed with resetting of the vehicle between each change of direction of movement of the limb.

There is therefore a need for an improved mechanism for enabling vehicles to traverse terrain, which has wide applicability, convenience and customizability, and which does not require substantial reconfiguration of the vehicle itself.

SUMMARY OF INVENTION

According to an aspect of the present invention, there is provided a wheel assembly for a vehicle, comprising a plurality of wheels, a plurality of rotary drive modules each having a respective rotation axis, and a plurality of rotatable arms, wherein each of the plurality of rotatable arms is arranged to extend radially from a rotation axis of a respective rotary drive module to couple the respective rotary drive module to a respective wheel of the plurality of wheels, wherein each rotary drive module is operable to drive rotation of a respective rotatable arm about the rotation axis of the drive module, such that the respective wheel of the plurality of wheels is caused to rotate about the rotation axis, the apparatus further comprising a control module comprising means for sensing stepped terrain, and in response to sensing stepped terrain, the control module is arranged to control each rotary drive module such that the rotation of the plurality of wheels about their respective rotation axes enables a vehicle supported by the plurality of wheels to travel over the stepped terrain.

The control module may be arranged to control at least two of the rotary drive modules simultaneously.

The plurality of wheels may include powered non-steerable wheels and unpowered steerable wheels or powered steerable wheels and unpowered non-steerable wheels.

The wheel assembly may comprise a mechanism for controlling the coupling of at least one of the plurality of wheels to a respective rotatable arm, so as to maintain at least one of the plurality wheels in a fixed orientation relative to the wheel assembly as it rotates about the rotation axis of its respective rotary drive module.

The wheel assembly may comprise means for driving the wheel assembly linearly through rotation of at least one of the plurality of powered wheels about an axis through the centre of the at least one of the powered wheels.

The control module may be arranged to control the linear driving means to drive the wheel assembly while at least one of the plurality of wheels is arranged in a position which is not in contact with the terrain.

The control module may be arranged to control each of the plurality of rotary drive modules such that the respective wheels coupled to the rotary drive modules are moved in a sequence representative of a walking gait, such that at least two of the plurality of wheels are positioned on the terrain and at least one of the plurality of wheels is not in contact with the terrain at a point in time during the sequence.

The control module may be configured determine the centre of mass of a vehicle supported by the wheel assembly and may be arranged to control each of the plurality drive modules such that as the vehicle moves across the terrain, the position of the centre of mass of the wheel assembly is such that the vehicle is balanced.

Each of the plurality of wheels may have freedom to rotate around one or more revolutions of its respective rotation axis.

The means for sensing stepped terrain may comprise infrared and/or optical sensors.

The control module may store terrain profiles and provide control in response to recognising a stored terrain profile using the sensing means.

The control module may stores information relating to the dimensions of the wheel assembly and a vehicle supported by the wheel assembly, and may be arranged to determine and output an indication of whether or not it is possible for the vehicle to travel over sensed terrain based on the stored information.

According to another aspect of the present invention, there is provided a vehicle fitted with the above wheel assembly.

The vehicle may be a wheelchair, comprising an override mechanism for allowing a user of the wheelchair to override the control of the control means and to control the plurality of wheels manually.

The vehicle may comprise contact surfaces on the chassis of the vehicle to support the vehicle on the terrain during a sequence of movements of the plurality of wheels.

The wheel assembly of embodiments of the present invention represents a modular system which can be added to an existing vehicle, replacing or using current wheels and allowing the vehicle to traverse stepped or uneven terrain. This means that the wheel assembly enables greater customizability than known designs. For example, the solution of the present invention can be applied to a wheelchair, wheeled-walker, mobility scooter, supermarket trolley, delivery equipment, pushchair, robotic platform or exploration rover for Earth or another planetary body, toy or hobby vehicles, consumer vehicles, all-terrain vehicles, and vehicles for military transport. The system can also be specifically optimised for traversing small obstacles such as a limited number of steps or a curb, or for larger flights of steps or moving obstacles or changing terrain, and can do so ensuring balance and safe reliable mobility is achieved.

The intelligent control of the rotating wheel assemblies allows a vehicle to have electronic, intelligent suspension, which can adapt to the terrain it is crossing. It is possible to make changes to move the centre of mass and change the orientation, position of the chassis main body. With a modification of additional force feedback systems, it can be envisioned that this system can react to surface variations and loads, and can also take into account terrain information ahead of the system. With use of control software, design objectives can be met such as stable horizontal chassis orientation whilst traveling across uneven terrain.

BRIEF DESCRIPTION OF DRAWINGS

Embodiments of the present invention will be described by way of example only, with reference to the following drawings, in which.

DETAILED DESCRIPTION

Figure 1:
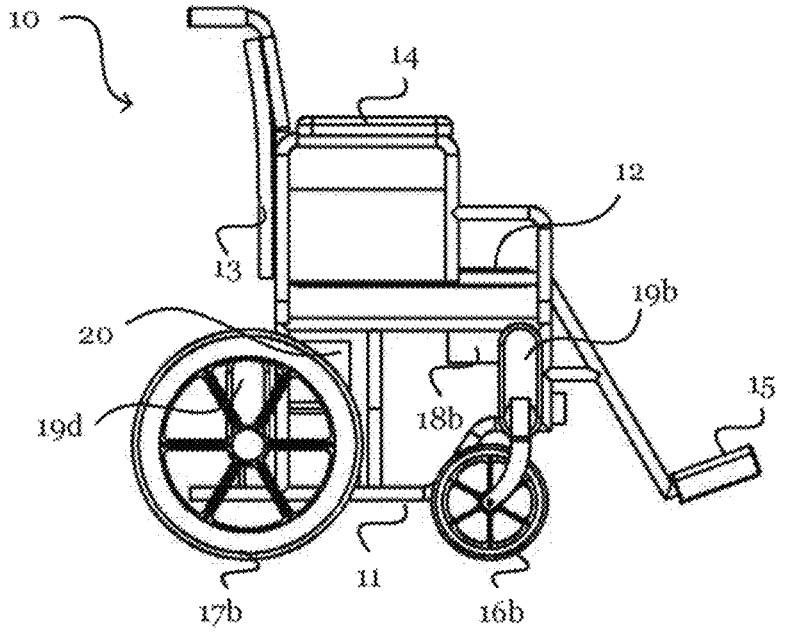
FIG. 1 illustrates a side view of a wheelchair to which a wheel assembly according to embodiments of the present invention is attached.
Figure 2:
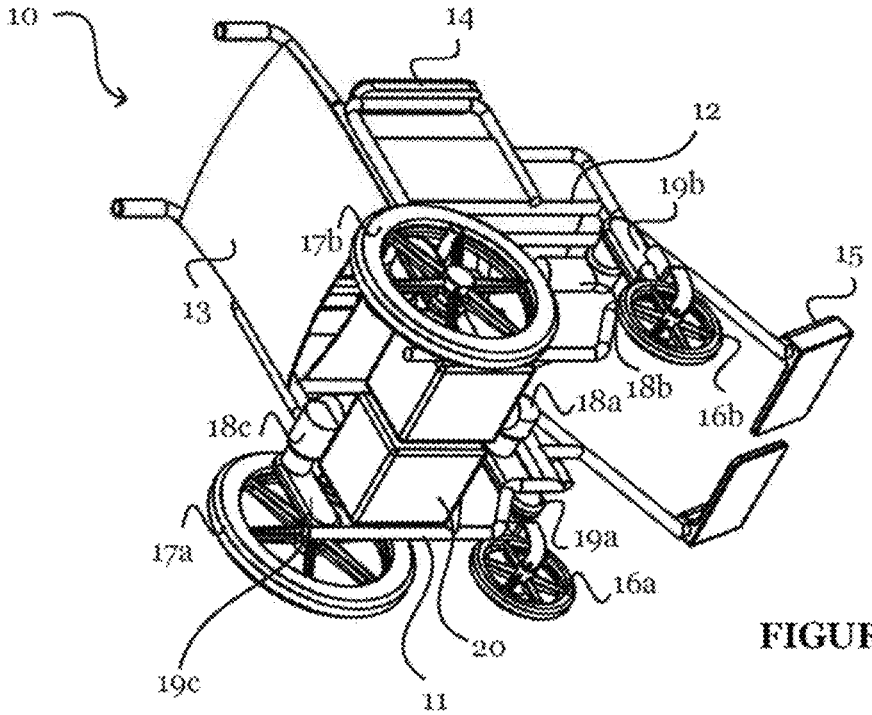
FIG. 2 illustrates an underside view of a wheelchair to which a wheel assembly according to embodiments of the present invention is attached.

FIG. 1 illustrates a side view of a wheelchair 10 to which a wheel assembly according to an embodiment of the present invention is attached. The wheelchair 10 will be described only as an example of a type of vehicle to which the wheel assembly can be attached, and it will be appreciated that alternative vehicles are compatible with the wheel assembly of the present invention. FIG. 2 illustrates an underside view of the wheelchair 10 illustrated in FIG. 1.

The wheelchair comprises a conventional chassis 11 including a seat 12, seat back 13, arm rests 14 and a footrest 15. The wheelchair has two unpowered, steerable front wheels 16*a*, 16*b*, and two powered, non-steerable rear wheels 17*a*, 17*b*. The rear wheels 17*a*, 17*b* are illustrated as larger than the front wheels 16*a*, 16*b*, and support the majority of the mass of the user and the wheelchair 10, facilitating movement of the front 16*a*, 16*b* wheels for steering.

The four wheels of the wheelchair 10 are part of the wheel assembly of the present embodiment. The wheel assembly also comprises four rotary drive modules (three of which 18*a*, 18*b*, 18*c* are visible from the perspective shown in FIGS. 1 and 2), and four rotatable arms 19*a*, 19*b*, 19*c*, 19*d*. The rotary drive modules 18*a*, 18*b*, 18*c* are mounted on the chassis 11 of the wheelchair 10, and each rotatable arm 19*a*, 19*b*, 19*c*, 19*d* extends from a respective rotary drive module to couple a respective one of the four wheels 16*a*, 16*b*, 17*a*, 17*b*, a rotatable arm 19*a*, 19*b*, 19*c*, 19*d* coupled to the rotatable element of a respective rotary drive module, and coupled to a respective wheel 16*a*, 16*b*, 17*a*, 17*b* through coupling portion at the central axle of the wheel. Rotatable arm 19*a* is illustrated as extending from rotary drive module 18*a* to front left wheel 16*a*, rotatable arm 19*b* is illustrated as extending from rotary drive module 19*b* to front right wheel 16*b*, rotatable arm 19*c* is illustrated as extending from rotary drive module 18*c* to rear left wheel 17*a* and rotatable arm 19*d* is illustrated as extending from a rotary drive module concealed by rear right wheel 17*b*.

The wheel assembly also comprises a control module and associated electrical hardware for powering and driving the components of the wheel assembly, which is contained within a housing 20. The control module provides activation signals to each rotary drive module 18*a*, 18*b*, 18*c* to cause the rotary drive modules 18*a*, 18*b*, 18*c* to provide rotational drive about respective rotation axes. The activation signals may be binary on/off signals coupled to associated drive circuitry, or may contain data or control words defining extents of rotation, dependent upon the particular implementation of the rotary drive modules used.

The rotation axis of each rotary drive module 18*a*, 18*b*, 18*c* extends in a direction substantially parallel to the axle of a rear wheel 17*a*, 17*b*. Since the front wheels 16*a*, 16*b* are steerable in the illustrated configuration, they may rotate with respect to the rotation axes of the front wheel rotary drive module 18*a*, 18*b*, although it is clear that the specific configuration of rotation axes is dependent on a particular vehicle and wheel assembly. In the case of FIG. 1, for example, the rotation axis thus extends perpendicular to the plane of the side of the wheelchair 10, as will be illustrated with respect to FIGS. 3 and 4.

According to embodiments of the present invention, the drive of a rotary drive module causes a corresponding rotatable arm to rotate about the rotation axis of the rotary drive module, the rotatable arm being coupled to the rotatable element of the rotary drive module at the rotation axis. Rotating the rotatable arm in this manner in turn causes the centre of the wheel to be rotated about the rotation axis.

Figure 3:
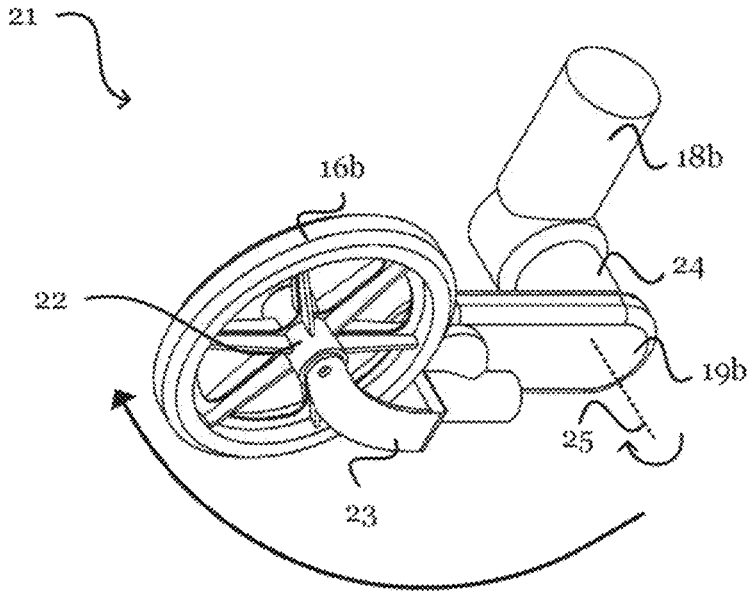
FIG. 3 illustrates the configuration of a front right wheel sub-assembly of the wheel assembly of embodiments of the present invention, when viewed from the side.
Figure 4:
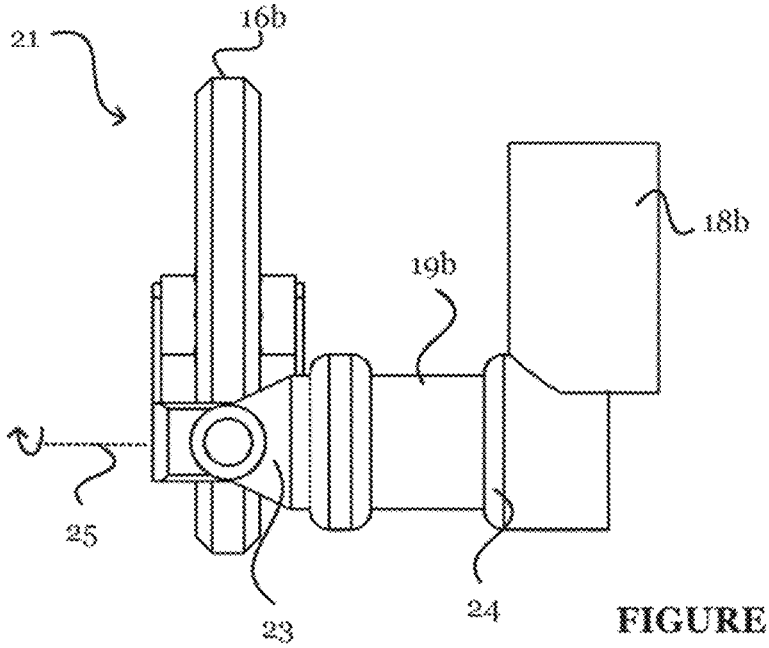
FIG. 4 illustrates the configuration of the front right wheel sub-assembly shown in FIG. 3 when viewed from the front.

FIG. 3 illustrates the configuration of a front right wheel sub-assembly 21 of the wheel assembly of an embodiment of the present invention in more detail, when viewed from the side. As described above, the existence of a front right wheel is dependent upon the configuration and distribution of the wheels of a vehicle with which the wheel assembly is intended to be used, and is described to facilitate illustration of the present invention. FIG. 4 illustrates the configuration of the front right wheel sub-assembly 21 shown in FIG. 3 when viewed from the front. The configurations illustrated in FIGS. 3 and 4 are referred to herein as a sub-assembly of the wheel assembly of embodiments of the present invention, the wheel assembly comprising a plurality of sub-assemblies in dependence upon the number of wheels of the vehicle. In the present embodiments, each sub-assembly comprises a single wheel, a rotary drive module and a rotatable arm.

As shown in FIG. 3, the centre of the wheel 16*b* is coupled via an axle 22 and a coupling portion 23 to the rotatable arm 19*b*. The rotatable arm 19*b* may be offset from the centre of the wheel 16*b* such that the coupling portion 23 is curved or bent. This enables optimisation of the mounting of the wheel assembly and particularly the wheels of the wheel assembly to the wheelchair. In modifications of the present embodiment, the rotatable arm 19*b* need not be offset from the centre of the wheel 16*b*, and so the coupling portion 23 can be straight and/or integral with the rotatable arm 19*b*. The fixing of the coupling portion 23 to the wheel axle 22, and of the coupling portion 23 to the rotatable arm 19*b*, can take the form of adhesive or mechanical coupling via screws, bolts and the like, or combinations thereof.

The rotatable arm 19*b* is coupled to a rotatable element 24 of a rotary drive module 18*b*. In the present embodiment, the rotary drive module 18*b* is a brushed DC motor, but a brushless motor may be used instead. The motor may be a stepper motor having a rotation angle which can be controlled via an appropriate control signal. The rotation axis 25 of the rotary drive module 18*b* is shown in FIGS. 3 and 4. The rotation axis 25 may be a translated version of the rotation axis of the rotor of a motor. In the configuration illustrated in FIG. 3, for example, the rotor may be housed in the housing of the rotary drive module 18*b*, and a bevel gear system coupled to a rotating shaft may cause the rotation of the rotor of the motor to be translated into the direction of rotation axis 25 shown in FIG. 3. Rotation in a clockwise, anti-clockwise or in both directions may be possible. Clockwise rotation is illustrated for convenience. On operation of the rotary drive module 18*b*, the wheel 16*b* is caused to rotate about the rotation axis 25. The rotatable arm 19*b* is free to rotate all the way around the rotation axis 25 without restriction.

The ability to rotate a wheel around the rotation axis of its corresponding rotary drive module provides the ability to raise or lower the wheel relative to the chassis of the wheelchair, as will be illustrated in more detail below, in a continuous or substantially continuous motion which does not require interruption through reciprocation of the motion direction. Through driving the rotation of a plurality of wheels, under the control of a control module, it is possible to design a sequence of movements of each of the wheels which enables a walking gait, or a gait partially resembling walking, to be simulated, and the walking gait of the wheel assembly enables the wheelchair to traverse stepped terrain. For example, with the front left and rear wheels on the terrain, the front right wheel can be rotated into a position which enables it to be positioned onto a step in front of the wheelchair. Once the front right wheel is on the step, the front left wheel can be similarly positioned on the step, and the wheelchair can then be manoeuvred up onto the step through a similar walking gait of the rear wheels and appropriate propulsion of the wheelchair. It is not essential for the gait to be considered as a walking gait, however, since this is simply a characterisation of an exemplary sequence of steps which achieve the effect of the present invention.

FIGS. 5 to 13 illustrate a process of climbing a step which can be performed by a wheelchair 10 to which a wheel assembly according to an embodiment of the present invention is attached, the wheelchair 10 illustrated as in FIGS. 1 and 2. The step in the present example may be a relatively conventional step, having a height of the order of 20 cm. As set out above, the wheelchair is simply an exemplary vehicle, and the illustrated principle of movement can be applied to any appropriate vehicle. In addition, the principle of movement can be applied to multiple steps, whether an ascent or descent, or whether in a forward or reverse direction, and the step may instead be another obstacle or section of uneven terrain. Directions of motion are illustrated in dotted lines, and the terms "clockwise" and "anti-clockwise" are defined with respect to the perspective illustrate in the Figures. For example, an "anti-clockwise" motion of the front left wheel by its respective rotatable arm corresponds to a motion in which the wheel is moving upwards when rearward of the rotation axis of the rotary drive module, and is moving downwards when forward of the rotation axis.

Figure 5:
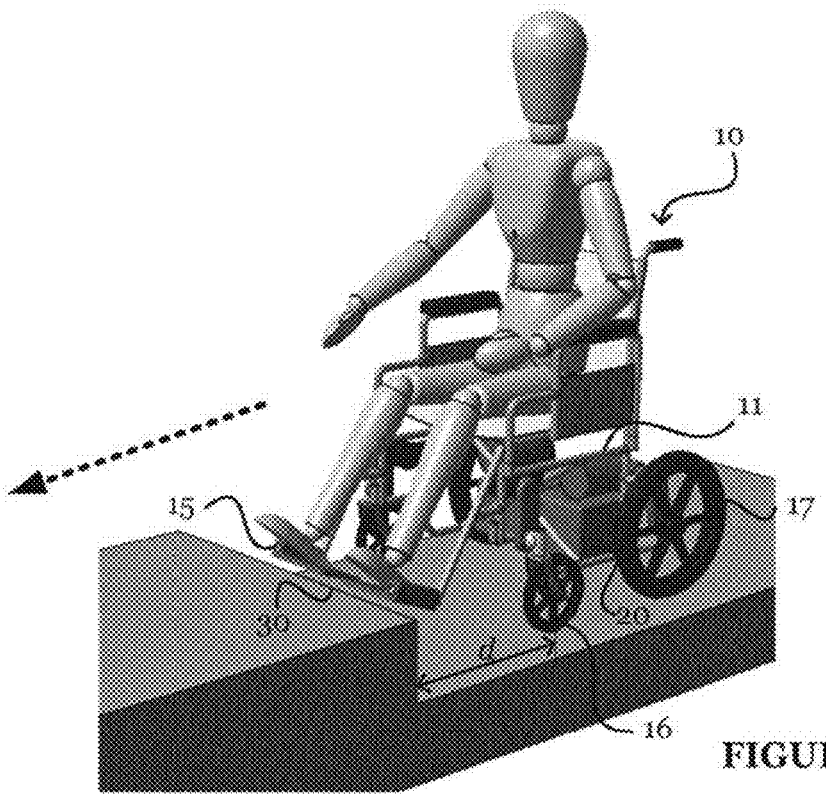
FIGS. 5 to 13 illustrate a motion sequence of a vehicle climbing a step when using the wheel assembly of embodiments of the present invention.

FIG. 5 illustrates the wheelchair 10 approaching a step 30. A sensor (not shown) senses the presence of the step 30. The sensor may be any appropriate proximity sensor such as an infra-red range finder, an ultrasonic ranger, or an optical system such as a camera vision system, performing edge and/or surface detection or other image processing suitable for detecting the step.

The sensor provides a signal to the control module of the wheel assembly providing an indication of the upcoming step, the control module housed 20 under the chassis 11 of the wheelchair 10. The control module will permit the wheelchair 10 to approach the step 30 until it is at a predetermined distance, d, from the step 30, measured between the front wheels 16 and the step 30, although it may alternatively be possible to take the measurement from another part of the chassis 11 such as the footrest 15. The predetermined distance d is one at which provides sufficient space for the wheelchair 10 to begin a climbing sequence, as will be described below.

The wheelchair illustrated in relation to the present embodiment is powered through mechanical drive components (not shown) attached to the rear wheels 17 which interface with the control module of the wheel assembly. As such, the control module is able to control not only the operation of the wheel assembly in terms of the rotation effect illustrated in FIGS. 3 and 4, but also the driving of the rear wheels 17 around their own central axes to drive the wheelchair 10 forwards or backwards. When the wheelchair 10 reaches the predetermined distance d from the step, the control module operates to stop driving of the rear wheels 17.

Figure 6:
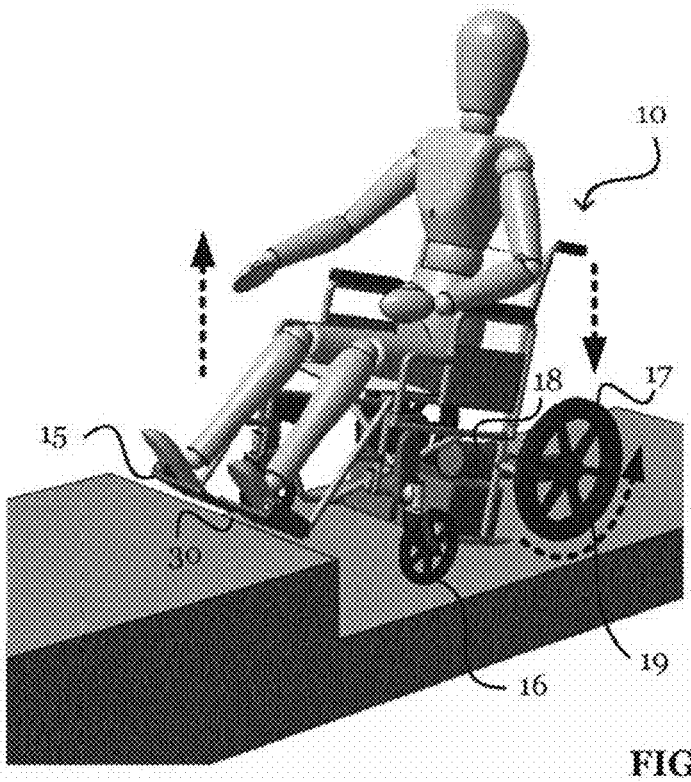

FIG. 6 illustrates the process of preparing the wheelchair 10 to climb the step 30. The rear wheels 17*a* are lowered, which brings the front of the chair upward, lifting the footrest 15 above the step height. The lowering of the rear wheels 17 is achieved by rotating the rotatable arms 19 of the rear wheel sub-assemblies in the direction shown in FIG. 6 (the anti-clockwise direction in the case of the rear left wheel), which has the effect of rotating the rear wheels 17 such that their height relative to the wheelchair chassis 11 is changed, and their distance relative to the front wheels 16 is increased. The chassis 11 of the wheelchair 10 thus tilts under gravity as illustrated. In the configuration of FIG. 6, all four wheels remain in contact with the ground.

As described above, the degree of rotation of the rear wheels 17 by the rotary drive module 18 is such that the user's feet and the footrest 15 of the wheelchair 10 is higher than the step 30 to be climbed, and the degree of rotation is controlled by the control module, based on the information received from a terrain sensor which can be used to determine the height of the step 30.

Figure 7:
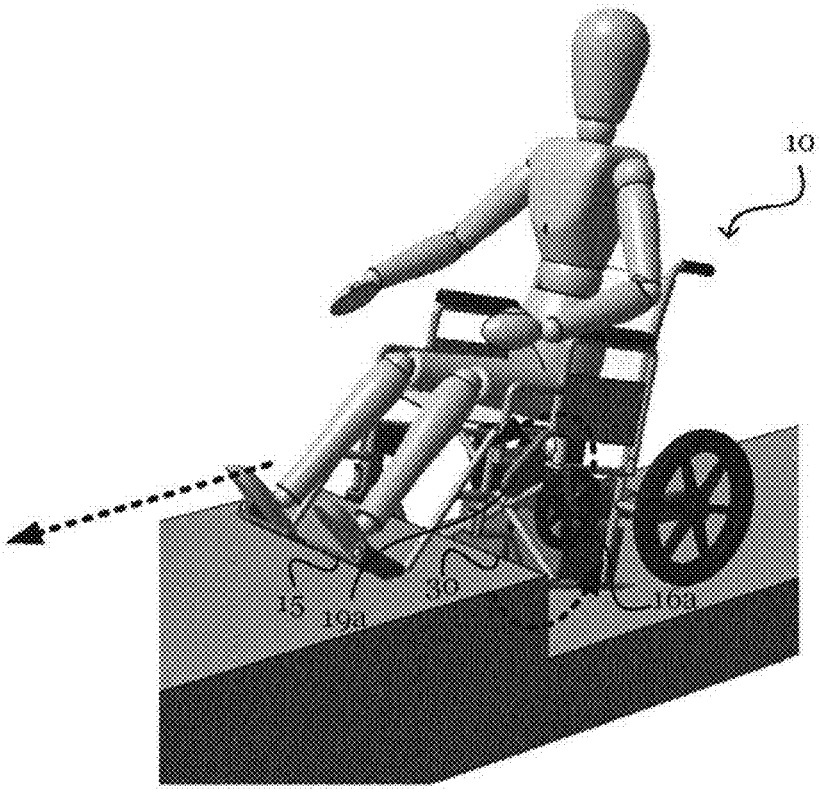

FIG. 7 illustrates the first stage of a walking gait which is used to climb the step. Since the height of the footrest 15 of the wheelchair 10 is above the step 30 to be climbed, the wheelchair 10 is able to move forward, relative to the step 30, a short distance, until the front wheels 16 are close to the step face, the footrest 15 clearing the top of the step 30. The wheelchair then stops 10, and the front left wheel 16*a* of the wheelchair 10 is lifted by rotation motion of its corresponding rotary drive module (not shown) and rotatable arm 19*a* in the anti-clockwise direction. At this point, only three wheels of the wheelchair 10 are in contact with the terrain since the front left wheel 16*a* is suspended above the terrain. Rotation of the front left wheel 16*a* about the rotation axis of its rotary drive module continues in the same anti-clockwise direction until the wheel 16*a* is in contact with the top of the step 30. Having reached the top step, rotation of the front left wheel 16*a* stops, and the same process of wheel-lifting is performed by the front right wheel sub-assembly through rotation of its rotary drive module (not shown). This step of the sequence concludes when the front right wheel is on the top of the step 30, and the result is illustrated in FIG. 8, in which all four wheels in contact with the terrain, the rear wheels 17 in contact with the lower surface of the step 30, and the front wheels 16 in contact with the upper surface of the step 30.

The alternating motion of the front left and front right wheels can be considered in some embodiments to represent the "walking" gait of the entire motion sequence, analogous to the alternating motion of each of a pair of limbs during walking.

Figure 8:
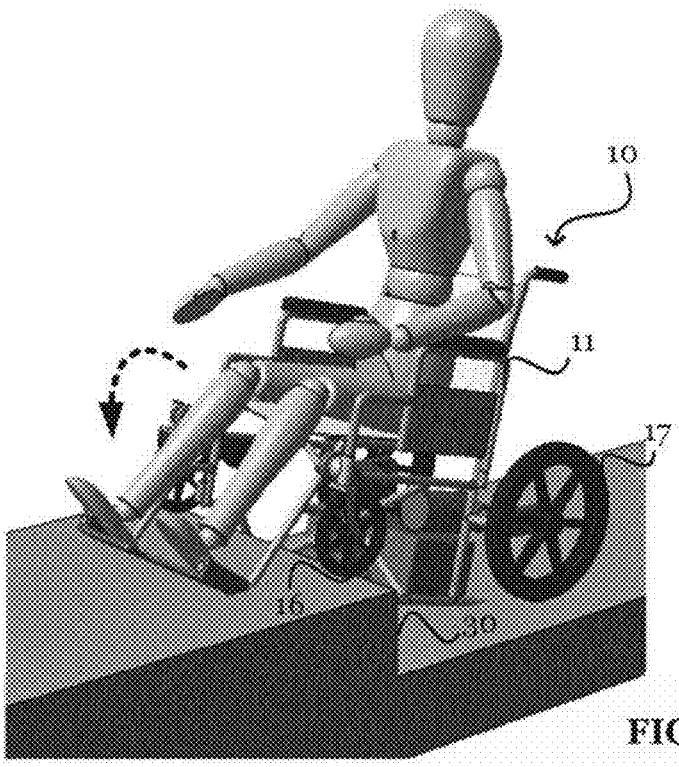
Figure 9:
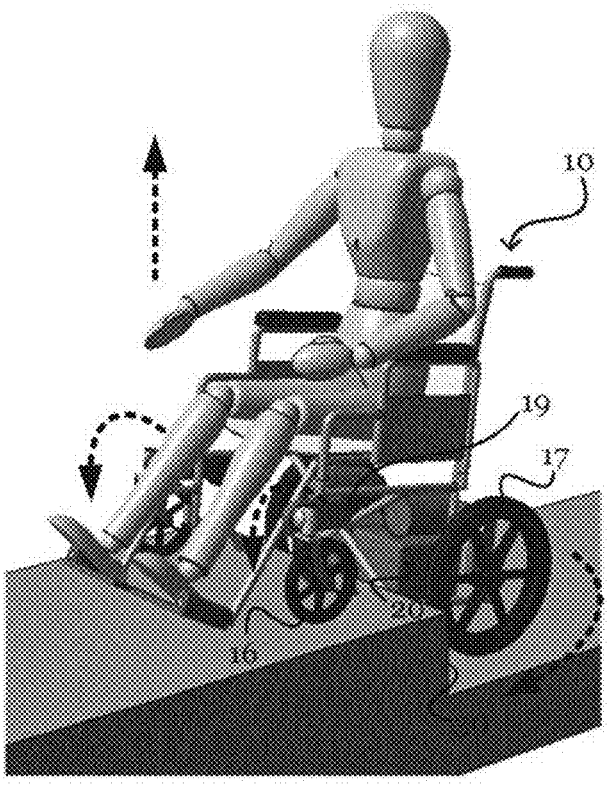

The next step of the sequence is illustrated in FIG. 9, and involves the movement of the wheelchair 10 towards the step 30 such that the rear wheels 17 come into contact with, or are close to, the face of the step 30. As the wheelchair 10 is driven forwards, lifting of the wheelchair 10 is achieved by rotation of the rotatable arms 19 of each of the four wheels in unison. The front and rear wheels 16, 17 are rotated in opposite directions, such that the rear wheels 17 are is rotated in the clockwise direction while the front wheels 16 are rotated in the anti-clockwise direction, as illustrated. The use of opposite rotation directions arises as a consequence of the rotatable arms of the front and rear wheel sub-assemblies extending in opposite directions in the configuration of FIG. 8 in the previous step of the sequence, in which the rotatable arms of the front wheels 16 extend forwards from the chassis 11, while the rotatable arms of the rear wheels 17 extend rearwards from the chassis. Accordingly, the rotation of the rotatable arms is so as to provide a lifting effect to the wheelchair 10 through pushing the wheels 16, 17 against the terrain. The lifting motion provides preparation for the undercarriage of the wheelchair 10, providing housing 20 for the control module of wheel assembly, to be able to clear the edge of the step 30.

Figure 10:
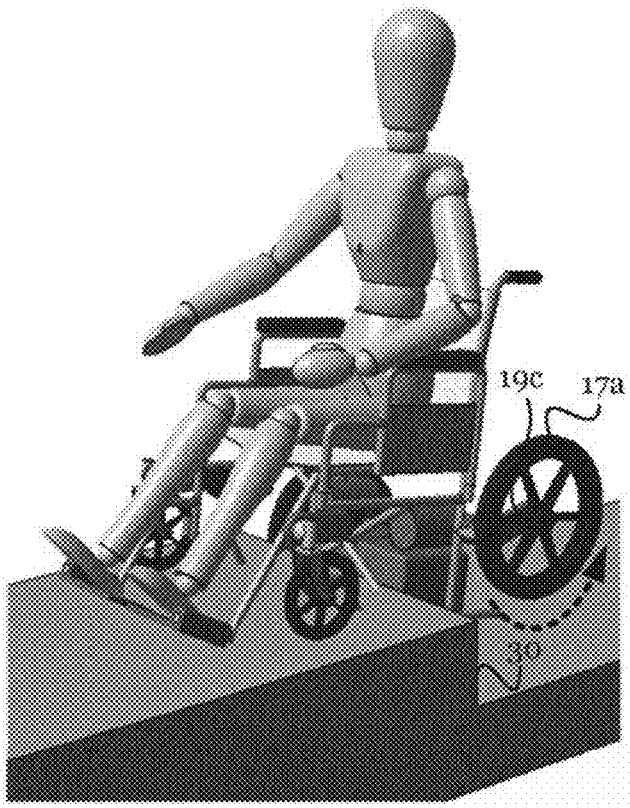
Figure 11:
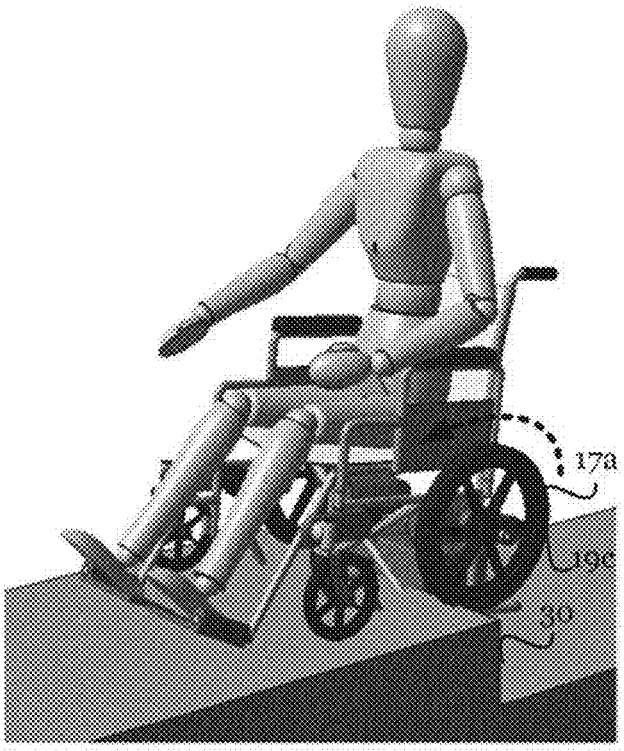

The next step of the sequence is illustrated in FIGS. 10 and 11, and is analogous to that illustrated in FIGS. 7 and 8, with rotation of the rear wheels by their respective rotatable arms, rather than rotation of the front wheels. In the present embodiment, the rear left wheel 17*a* is lifted through rotation of its respective rotatable arm 19*c* in the anti-clockwise direction, until the wheel reaches the top of the step 30. During this rotation action, only three wheels are in contact with the terrain. Once the rear left wheel 17*a* has reached the top of the step 30, a corresponding rotation of the right rear wheel (not shown) is performed until it reaches the top of the step 30. The motion of the rear wheels thus represents a walking gait.

Figure 12:
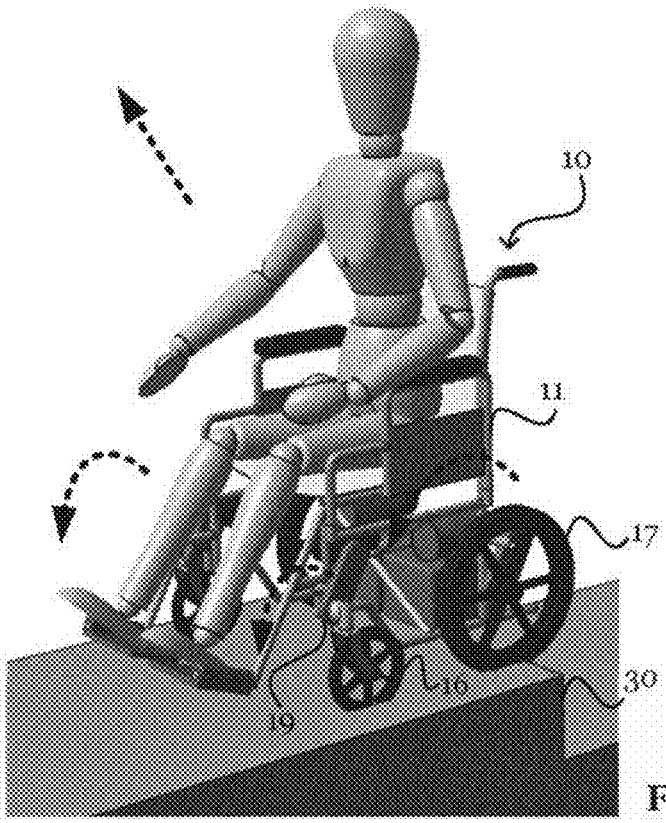
Figure 13:
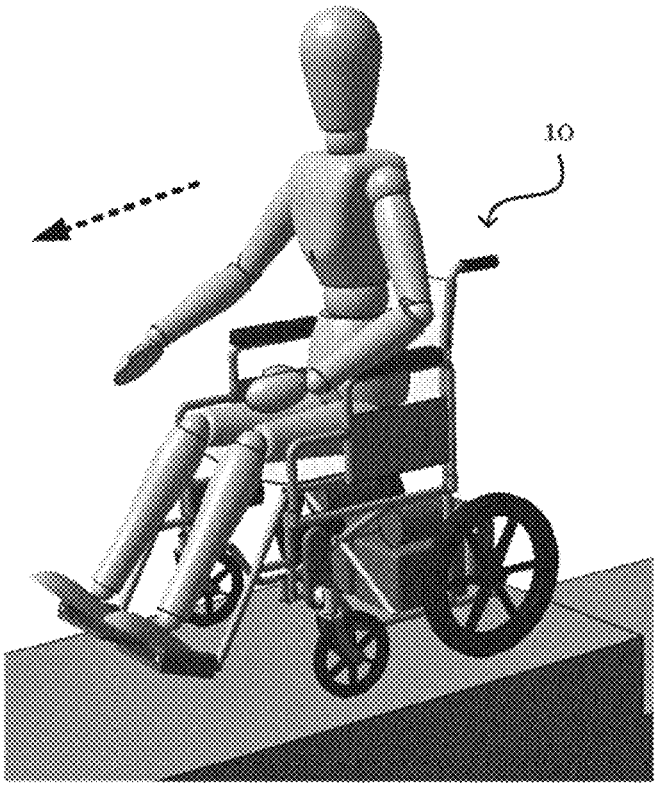

With all four wheels on the top of the step 30, the next step in the sequence is a process of lifting the wheelchair 10 into a position in which it is free to continue moving along the terrain. The lifting motion ensures there is sufficient clearance for the undercarriage of the wheelchair 10, and is achieved by rotation of all four rotatable arms 19 in the anti-clockwise direction, so as to push the wheels 16, 17 into the ground and consequently push the chassis 11 upwards, as illustrated in FIG. 12. The wheelchair 10 is then free to continue travelling, as illustrated in FIG. 13, and climbing of further steps can be performed by repetition of the entire walking sequence described above.

In the present embodiment, the control module of the wheel assembly controls the timing and operation of each stage of the above-described sequence to enable to the vehicle, to which the wheel assembly is mounted, to traverse the terrain.

The control module may comprise a microcontroller storing computer-executable instructions which, when executed, cause control of the wheel assembly to enable the vehicle to traverse the terrain. In alternative embodiments, the control module may be implemented entirely in hardware, or entirely in software, or a combination of hardware and software. The control module may comprise an interface such as a Universal Serial Bus (USB) socket or variants thereof, or I2C, RS232, CAN data buses or the like, wireless communication links such as WiFi, Bluetooth, to enable programming or updating of the control module. The control module may comprise a user interface to provide status or diagnostic information to a user, or to enable the control of the steps of the deployment sequence as described above.

The control module may thus be programmed to predetermine some aspects of the walking sequence, but other aspects of the walking sequence are determined on-the-fly, such as the height of a step or size of an obstacle, determined by a terrain sensor. The terrain sensor may operate using edge and/or surface detection, for example, such that it is able to detect both upward and downward fluctuations in the surface of the terrain.

It may be determined that the rotatable arms and/or wheels have reached a particular starting or ending position through use of rotational sensors, rotary encoders on the rotatable arms or rotary drive modules, such that the configuration of a sub-assembly, and the wheel assembly as a whole, can be determined and controlled by the control module. For example, where the rotary drive modules use stepper motors, the angle of the rotation of the stepper motors can be determined in accordance with a target position of the rotatable arm, based on dimensions of the rotatable arm, wheel, vehicle and terrain to be traversed, which are known to the control module. Potentiometers may also be used as alternatives to the rotary encoders, as will be understood by those skilled in the art.

In modifications of the above embodiments, the control module may provide intelligent control to preserve a particular orientation of the vehicle when traversing the terrain. For example, where the vehicle is a wheelchair, it is desirable for the wheelchair to be controlled so that it is as level as possible at all times, minimising discomfort to a user. In order to preserve such balance and/or orientation, the wheel assembly may be fitted with balance sensors such as gyroscopic sensors and gravitational sensors for determining the centre of mass of the vehicle, and the control module may receive information from the balance sensors and to control movement of particular sub-assemblies in accordance with feedback from the balance sensors, via a series of micro-sized movements or adjustments, for example. In some embodiments, the speed of rotation of a wheel by a rotatable arm may be reduced if it is determined that the vehicle is becoming unstable through sensing rocking of the vehicle from side to side. In further embodiments, it may be possible to control driving of individual wheels or wheel sub-assemblies to provide motion which acts to preserve the balance of the vehicle when performing a lifting or lowering operation using another wheel assembly, during the sequence described with respect to FIGS. 5 to 13.

The control module may automate the entire walking sequence of the wheel assembly, to occur as a continuous sequence of steps. Alternatively, the control module may be configured such that a number of steps may require prompting from a user before a subsequent step can occur. In further modifications, the user may be provided with the ability to repeat, reverse, or pause particular aspects of the walking sequence in order to correct any positioning errors which might occur. This feature might be appropriate in order to ensure that balance of the vehicle is maintained, or in order to account for changing terrain, which could be caused by introduction of foreign objects, or the collapse or modification of the profile of the terrain under the weight of the vehicle. Such user control may also take the form of an override button which enables operation of the control module to be overridden and controlled manually, preventing climbing of a step for example.

In the embodiment described above, it is specified that drive of the rear wheels of the vehicle may be controlled by the control module. This is not essential, however, and in alternative embodiments, the vehicle may be powered manually, or via an automatic system which is separately controlled from wheel assembly. In such automatic systems, in which at least one of the vehicle wheels is powered, the wheel assembly of embodiments of the present invention is compatible with any combination of drivable and non-drivable wheels.

In such embodiments, the control module may display guidance to a user on a user interface, to prompt the user to control driving motion of the vehicle at particular stages of the walking sequence, such as the step approach illustrated in relation to FIG. 5, and the control module may control only rotation of wheels by the rotary drive modules. The predetermined distance from a step or obstacle in the terrain, at which the vehicle is stopped on the approach illustrated in FIG. 5, may be calculated by the control module such that the subsequent walking sequence is safe and preserves balance of the vehicle. If the vehicle stops too close to the step, for example, a steep angle of climb or descent may be required, which may be dangerous, while if the vehicle stops too far from the step, it may be more difficult to ensure that the front wheels of the vehicle are securely positioned on a step during the sequence.

As described above, the wheel assembly of the present invention may be mounted to any desired vehicle, and the control module is appropriately configured for each application. The nature of the vehicle may determine the number of wheels to be controlled. It will be appreciated, for example, that different vehicle designs may require more or fewer than the four wheels illustrated in relation to the embodiments described above. For example, some wheelchair designs may have six or eight wheels, some vehicles may have three wheels, and so on. In addition, instead of wheels, casters or rollers may be used, and two rollers of sufficient width may be sufficient to balance the vehicle. The term "wheel" shall be used interchangeable herein with "casters" and "rollers". In each case, the wheel assembly shall contain as many sub-assemblies as required to move a particular wheel/caster/roller to achieve the required motion of the vehicle. The wheel assembly of embodiments of the present invention can be mounted to the chassis of a vehicle and the wheels of the vehicle prior to mounting of the wheel assembly can then be integrated into the wheel assembly so that it is not necessary to use a new set of wheels. The wheel assembly can thus take advantage of the optimisation of the wheels for the vehicle, such as the materials used or the distribution of wheel shapes and widths at different positions on the vehicle.

In embodiments in which a large number of wheels is required, it may be possible for the control module to move a plurality of wheels at the same time in order to increase the speed with which terrain may be traversed. This can be appropriate, for example, where the length of the vehicle spans a plurality of irregularities in the terrain, and specific groups of wheels are required to traverse specific irregularities at any particular stage in the progress of the vehicle across the terrain. In these embodiments, the control module may be arranged to instigate and control walking sequences of specific groups of wheels in parallel, and the terrain sensor may be configured such that a plurality of terrain sensing operations can be performed in parallel in association with particular wheels.

Wheel assemblies according to embodiments of the present invention comprise a plurality of wheels such that at least two wheels are present to enable the walking sequence to be achieved. It may be the case, however, that not every wheel/caster/roller of a vehicle needs to be rotatable in the manner illustrated in relation to the wheel assembly of the present invention. Accordingly, a wheel assembly according to some embodiments need not contain the same number of wheels as the vehicle to which it is intended to be mounted. For example, a vehicle may contain four wheels as illustrated in FIG. 1, but may contain two additional wheels which are fixed to the chassis and cannot be rotated in the manner illustrated with respect to a wheel assembly according to the present invention, although rotation of a fixed wheel about its central axis is possible. Such fixed wheels may provide support for the vehicle when crossing step edges, for example, through enabling the vehicle to roll over an obstacle, or for assisting with support of a vehicle during a walking sequence, in which not all of the wheels of the vehicle are in contact with the terrain. It may also be the case that such fixed wheels are not themselves rotatable about their central axes, and may alternatively take the form of hard protrusions or the like, mounted to a housing of the wheel assembly, which assist with balancing the vehicle. Such protrusions may be rubberized or contain surface roughness to increase frictional coupling with the terrain. Such protrusions may be particularly useful where a small number (such as four or fewer) wheels are present, to balance the vehicle when one wheel is lifted from the terrain. In some embodiments, the wheels and support protrusions may be configured so that there are a minimum of three points of contact between the wheel assembly and the ground at any point during the operation of the wheel assembly. The protrusions may be mounted to the vehicle chassis, or to the housing of the wheel assembly.

An advantage of the wheel assembly of the present invention lies in the fact that each wheel of a sub-assembly is rotatable all the way around the rotation axis of a rotatable arm, without restriction, which represents a significant degree of freedom for the wheel assembly as a whole, and facilitates movement of the vehicle over a variety of terrains. The spatially continuous motion which is made possible enables a plurality of sequences of motion to be performed consecutively, such as the climbing of a flight of steps. In addition, the ability of a wheel to be freely rotated avoids the need for system resetting that would be required if the wheel were to be moved on a reciprocating limb. For example, it can be seen that in the front wheel sub-assemblies illustrated in FIGS. 5 to 13, the rotatable arm of the front left sub-assembly only rotates in a clockwise direction during the sequence. On one complete revolution of the rotatable arm about its rotation axis, a walking sequence of one step has been completed. Although the rotatable arms of the rear wheel sub-assemblies illustrated in FIGS. 5 to 13 are shown as rotating in both clockwise and anti-clockwise directions to facilitate lifting and tilting operations, it will be appreciated that for certain terrain, and vehicle dimensions, it is possible for such operations to be omitted. For example, it may be possible for the rear wheels of a vehicle to climb from a first step to a second step at the same time as the front wheels of a vehicle climb from the second step to a third step. The walking gait in this configuration could be achieved by moving the front left wheel at the same time as the rear right wheel, in a four-wheel configuration, and moving the front right wheel at the same time as the rear left wheel, in order to maximise balance of the vehicle, and the rotatable arms of the rear wheels would complete a single revolution in each step-climbing operation. In this embodiment, it would be possible for the distance between front and rear wheels to be adjustable via a sliding mechanism or the like in order to fit a particular terrain profile that may be known in advance, to facilitate smooth simultaneous operation of the front and rear wheels.

In some embodiments, the control module may be such that it is able to learn new terrain to enable it to recognise that terrain in the future, by building up and storing locally a series of known terrain profiles and geographic locations, for example defining, for example, one of a number of parameters such as smoothness, steepness, frequency of undulations, terrain material and so on. On sensing particular terrain, one or more aspects of the sensed terrain can be compared with a corresponding aspect in a data set representing a stored profile. This would be particularly advantageous in cases where the vehicle is intended for repeated use in a relatively small number of locations, or where movement sequences are to be repeated such that the vehicle can traverse a series of stairs in a staircase, for example.

In addition, in some embodiments, the control module is able to determine, either based on a stored profile, or based solely on information from the terrain sensor, whether the vehicle is able to traverse particular terrain, and to provide a corresponding indication to a user via a user interface such as a display. The control module may be programmed, either through factory configuration, or via a user interface, with information defining the dimensions of the vehicle and particular tolerances such as a maximum permissible angle of incline or decline for the vehicle, and based on this information, the control module can compare the upcoming terrain with the stored vehicle information to determine whether the vehicle can in fact be moved over the terrain within the defined constraints. In some embodiments, the terrain sensor may be termed an "environment" sensor as in addition to measuring the terrain, three-dimensional information relating to the width between two obstacles or the height of an obstacle suspended above the terrain may also be measured in order to determine whether a vehicle can fit though a gap between such obstacles.

Figure 14:
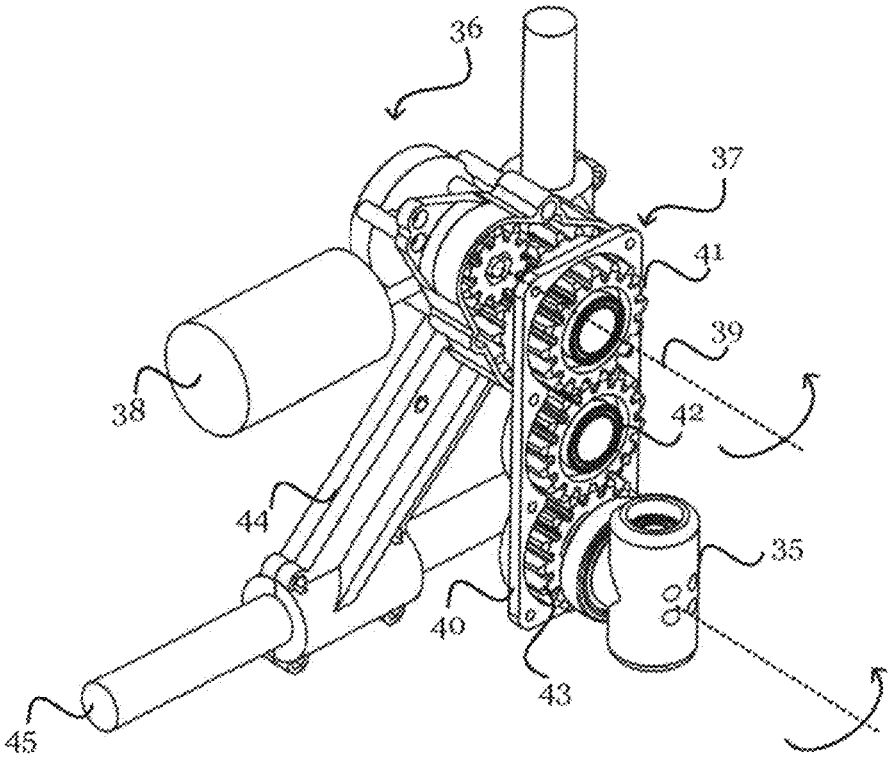
FIG. 14 illustrates a drive mechanism for a wheel in a wheel assembly according to further embodiments of the present invention.

FIG. 14 illustrates the driving components 35 of a front wheel sub-assembly of the wheel assembly of a further embodiment of the present invention. The driving components 35 correspond to the rotary drive module and a modified version of the rotatable arm of the previously-described embodiments.

The wheel sub-assembly comprises a wheel mount 35 for coupling the wheel (not shown) to the drive mechanism 36, and a three-gear mechanism 37, which is coupled between the wheel mount 35 and a rotatable element of a rotary drive module 38.

The three-gear mechanism 37 operates such that the wheel mount 35 is preserved in a fixed orientation relative to the terrain during the walking sequence of the wheel assembly. In the present embodiment, the fixed orientation is perpendicular to substantially flat terrain, matching the longitudinal extent of the wheel mount 35 illustrated in FIG. 14.

The rotary drive module 38 generates rotational drive about a rotation axis 39 which is causes the three-gear mechanism 37 to be rotated about a pivoting axis of the three-gear mechanism 37. The pivoting axis may be the same as the rotation axis 39, but may be offset from the rotation axis depending on the nature of the coupling of the mounting surface 40 of the three-gear mechanism 37 to the rotary drive module 38. In the present embodiment, it will be assumed that the pivoting axis of the three-gear mechanism 37 is the same as the rotation axis 39, and that the three-gear mechanism 37 rotates to the right, in the anticlockwise direction, for the purposes of illustration.

The first gear 41 of the three-gear mechanism 37 is fixed to the structure of the drive mechanism 36 such that it moves relative to the mounting surface 40 of the three-gear mechanism 37 as the mounting surface moves relative to the structure of the drive mechanism 36. In the present embodiment, the first gear 40 rotates in the clockwise direction as the three-gear mechanism 37 rotates in the clockwise direction. The second gear 42 thus rotates in the anticlockwise direction, and the third gear 43 rotates in the clockwise direction.

The rotation of the third gear 43 in the clockwise direction, relative to the mounting surface 40, causes the wheel mount 35 to be rotationally offset from the mounting surface 40 in the clockwise direction, and the offset is such that the it corresponds to the amount of rotation of the mounting surface 40 of the three gear mechanism 37 caused by the rotary drive module 38, although depending on the size of the gears used, this need not be the case. The offset of the wheel mount 35 is configured such that the wheel mount 35 remains in the same orientation relative to the drive mechanism 36.

The drive mechanism 36 of the present embodiment comprises additional means 44 for securing the drive mechanism 36 to the chassis 45 of the vehicle, and for supporting the mechanism 36. The entire drive mechanism 36 may be manufactured using a technique such as additive manufacturing.

Instead of the configuration of FIG. 14, a pulley and belt system may be used to maintain the orientation of the wheel mount and the wheel, and dedicated drive systems may also be used to drive the angle of the wheel mount relative to the chassis of the vehicle. Instead of a three-gear system, systems of a larger number of gears, or different gearing system such as planetary gears or harmonic drive gears may also be used.

By maintaining the orientation of wheel mount in a fixed direction, it is possible to reduce the space required to rotate the wheel during a walking sequence. This can be advantageous in facilitating coupling of the wheel assembly to the vehicle.

Figure 15:
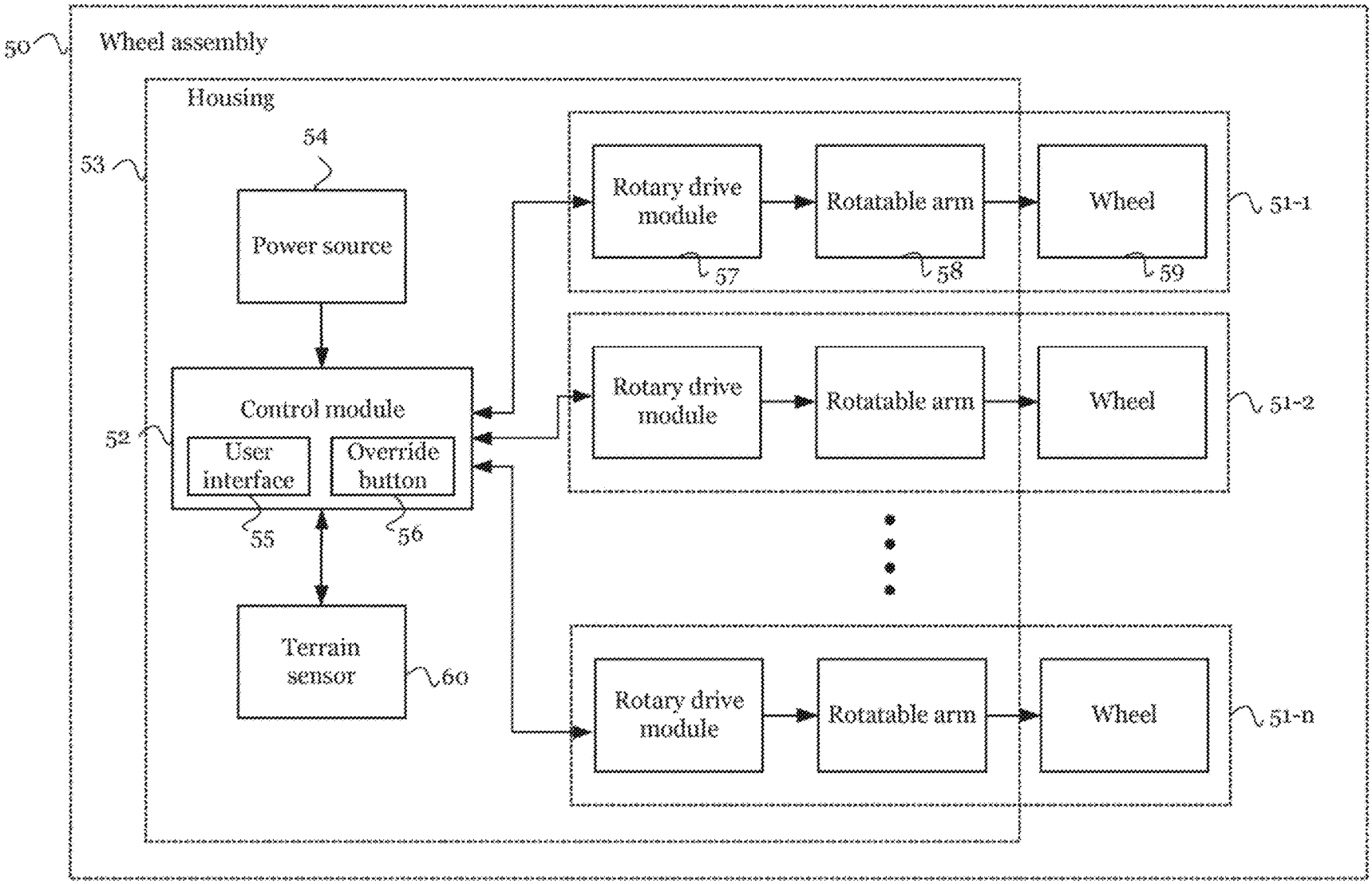
FIG. 15 is a system diagram of a wheel assembly according to embodiments of the present invention.

FIG. 15 is a system diagram of the components of a wheel assembly 50 according to an embodiment of the present invention. As has been described above, the exact number of components of the wheel assembly 510 is dependent on the vehicle to which the wheel assembly 50 is intended to be mounted, and it will be assumed for the present embodiment that there are n sub-assemblies 51-1, 51-2, . . . , **51-*n*** corresponding to n or more vehicle wheels, where n is two or more.

Central to the operation of the wheel assembly is a control module 52 which is mounted to the wheel assembly housing 53. Also contained within the housing according to the illustrated embodiment is a power supply 54, such as a battery, for powering the control module 42 and the rotary drive modules. The battery may be provided by the vehicle itself in conjunction with an automatic wheel drive system.

The control module 52 comprises a user interface 55 such as a display and a joystick, and an override button 56, although these components are not essential, particularly in cases where the interface is provided by a separate control system of the vehicle.

Each sub-assembly 51-1, 51-2, . . . , **51-*n* comprises a rotary drive module 57, a rotatable arm 58 and a wheel 59, as illustrated in conjunction with FIGS. 3 and 4. Each rotary drive module 57 is controlled by signals provided by the control module 52, in order to effect rotation of the wheel 59 about the rotation axis of the rotary drive module 57 in one or both directions, and the control module 52 is programmed to carry out sequences of motion of the wheels 59 to enable the vehicle to traverse particular terrain. The sequences of motion may represent a walking gait, although it will be appreciated that the sequences need not entirely correspond to such a gait. Two-way data communication lines are illustrated between the control module 52 and the sub-assemblies 51-1, 51-2, . . . , 51-*n* to represent feedback provided from, for example, a rotary encoder confirming the position of the wheel 59**.

It will also be appreciated that in some embodiments, the control module 52 may be configured as a master control module, coupled to a plurality of slave control modules 51-1, 51-2, . . . , **51-*n* controlling each individual sub-assembly, the master control module providing timing signals and overall system control, while the slave control modules provide control signals for rotary drive modules 57**.

In addition, the wheel assembly 50 comprises a terrain sensor 60, also referred to as an environment sensor, which senses upcoming terrain and/or the environment of the vehicle to which the wheel assembly 50 is attached, and which interfaces with the control module 52 to provide information regarding recognition of terrain, and information indicating whether it is possible for the vehicle to traverse a particular section of upcoming terrain. As described above, multiple terrain sensors may be used in modifications of the present embodiment.

The housing 53 for the wheel assembly 50 may be attachable to an appropriate part of a vehicle, such as the undercarriage, engine compartment, bridge, dashboard and so on. Depending on how the wheel assembly 50 is attached, the housing 53 may contain a different subset of components from those illustrated in FIG. 15. For example, the battery 54, control module 52, and terrain sensor 60 may be accommodated in the housing 53 while the wheel sub-assemblies 51-1, 51-2, . . . , **51-*n* are distributed about the vehicle, but in configurations having small numbers of wheels, for example, it may be possible to accommodate the wheel sub-assemblies 51-1, 51-2, . . . , 51-*n* (excluding the wheels) in the housing 53 itself in an area of the vehicle close to the wheels, such as the undercarriage, as illustrated in FIG. 2**.

It will be appreciated that a number of modifications to the embodiments of the present invention are possible and that aspects of different described embodiments which are compatible may be combined in order to achieve the driving of the wheels of a vehicle to overcome particular terrain. The described embodiments are therefore not to be interpreted as restrictive, but as examples of the present invention, the scope of which is defined by the appended claims.

The invention claimed is:

1. A wheel assembly for a vehicle, comprising:

a plurality of wheel sub-assemblies, wherein each wheel sub-assembly includes:

only one single wheel;

a rotary drive module having a rotation axis, each wheel sub-assembly configured to be connected to a chassis via the rotary drive module;

a rotatable arm configured to extend radially from the rotation axis of the rotary drive module to couple the rotary drive module to the wheel, the rotary drive module being operable to drive rotation of the rotatable arm about the rotation axis of the rotary drive module, to rotate the wheel fully about the rotation axis in a climbing operation;

a control module having means for sensing stepped terrain, and being configured to respond to sensing stepped terrain by controlling the rotary drive modules of the plurality of wheel sub-assemblies such that a rotation of a respective wheel about a respective rotation axis will enable a vehicle supported by the plurality of wheel sub-assemblies to travel over the stepped terrain; and means for driving the wheel assembly linearly through rotation of at least one of the plurality of powered wheels about an axis through a center of the at least one of the powered wheels, wherein the wheels of the plurality of wheel sub-assemblies include:

non-steerable wheels powered by a motor and steerable wheels not powered by a motor, and wherein the control module is configured to control each of the rotary drive modules of the plurality of wheel sub-assemblies such that the respective wheels coupled to the rotary drive modules will move in a sequence representative of a walking gait, such that at least two of the wheels of the plurality of wheel sub-assemblies will be positioned on terrain and at least one of the wheels of the plurality of wheel sub-assemblies will be out of contact with that terrain at a point in time during the sequence.

2. A wheel assembly according to claim 1, wherein the control module is configured to control at least two of the rotary drive modules of the plurality of wheel sub-assemblies simultaneously.

3. A wheel assembly according to claim 2, comprising:

a mechanism for controlling coupling of wheels of the plurality of wheel sub-assemblies to respective rotatable arms, so as to maintain the wheels in a fixed orientation relative to the wheel assembly when they rotate about the rotation axes of their respective rotary drive modules.

4. A wheel assembly according to claim 2, wherein the control module is configured to control the means for driving the wheel assembly linearly to drive the wheel assembly while at least one of the plurality of wheels is arranged in a position which is not in contact with terrain.

5. A wheel assembly according to claim 1, comprising:

a mechanism for controlling coupling of wheels of the plurality of wheel sub-assemblies to respective rotatable arms, so as to maintain the wheels in a fixed orientation relative to the wheel assembly when they rotate about the rotation axes of their respective rotary drive modules.

6. A wheel assembly according to claim 1, wherein the control module is configured to control the means for driving the wheel assembly linearly to drive the wheel assembly while at least one of the plurality of wheels is arranged in a position which is not in contact with terrain.

7. A wheel assembly according to claim 1 in combination with a vehicle, wherein the control module comprises:

means for determining a center of mass of the vehicle supported by the wheel assembly, and for controlling each of the drive modules of the plurality of wheel sub-assemblies such that as the vehicle moves across terrain, a position of a center of mass of the wheel assembly is such that the vehicle will remain balanced.

8. A wheel assembly according to claim 7, wherein the means for sensing stepped terrain comprises:

infrared and/or optical sensors.

9. A wheel assembly according to claim 8, wherein the control module is configured with terrain profiles, and is configured to recognize a stored terrain profile using the sensing means.

10. A wheel assembly according to claim 8, wherein the control module is configured with information relating to dimensions of the wheel assembly and a vehicle supported by the wheel assembly, and is configured to determine and output an indication of whether or not it is possible for the vehicle to travel over sensed terrain based on the stored information.

11. A wheel assembly according to claim 1, wherein each of the wheels of the plurality of wheel sub-assemblies has freedom to rotate around one or more revolutions of its respective rotation axis.

12. A vehicle comprising:

a vehicle chassis; and the wheel assembly of claim 1.

13. A vehicle according to claim 12, configured as a wheelchair, comprising:

an override mechanism for allowing a user of the wheelchair to override control of the control means to enable manual control of the plurality of wheel sub-assemblies.

14. A vehicle according to claim 13, comprising:

contact surfaces on the chassis of the vehicle to support the vehicle on the terrain during a sequence of movements of the plurality of wheels.

* * * * *